United States Patent [19]

Yang

[11] Patent Number: 4,767,374

[45] Date of Patent: Aug. 30, 1988

[54] SYNCHRONIZED DRIVE DEVICE FOR THE MOUTH OF A DOLL

[76] Inventor: Tai-Cheng Yang, 14, Lane 616, Cheng-Teh Rd., Taipei, Taiwan

[21] Appl. No.: 6,684

[22] Filed: Jan. 27, 1987

[51] Int. Cl.[4] ..... A63H 3/28; G09F 13/00

[52] U.S. Cl. ..... 446/301; 446/484; 40/458; 455/344

[58] Field of Search ..... 446/301, 297, 303, 175, 446/484; 40/457; 455/344

[56] References Cited

U.S. PATENT DOCUMENTS

| | | | |
|---|---|---|---|
| 2,324,774 | 7/1943 | Henry | 446/301 X |
| 4,139,968 | 2/1979 | Milner | 446/301 |
| 4,579,540 | 4/1986 | Ho | 446/301 |
| 4,665,640 | 5/1987 | Forsse et al. | 446/301 X |

FOREIGN PATENT DOCUMENTS

| | | | |
|---|---|---|---|
| 525317 | 5/1956 | Belgium | 446/301 |

*Primary Examiner*—Mickey Yu

*Attorney, Agent, or Firm*—Ostrolenk, Faber, Gerb & Soffen

[57] ABSTRACT

A synchronized drive device for the lips of a doll arranged to be driven in response to audio signals from a receiver or sound carrier within the doll. The device is entirely self-contained and insertable into and removable from the doll. It includes extending drive arms which may be connected to the lips of the doll. The device comprises a mouth frame, a principal machine for producing the audio signal and a control box and the connection from the control box to the upper jaw and lower jaw. The central part of the mouth frame receives the control box which can be connected to the mouth portion. The control box has drive rods for the upper and lower jaws driven from the control box. The control box includes an electromagnetic motor which is responsive in its operation to the audio output of the principal machine within the doll to rotate a gear that is connected to the drive rods to pivot them. The sound device drives the motor to move in forward and return directions to move the jaws apart and together.

6 Claims, 3 Drawing Sheets

A-A SECTION

B-B SECTION

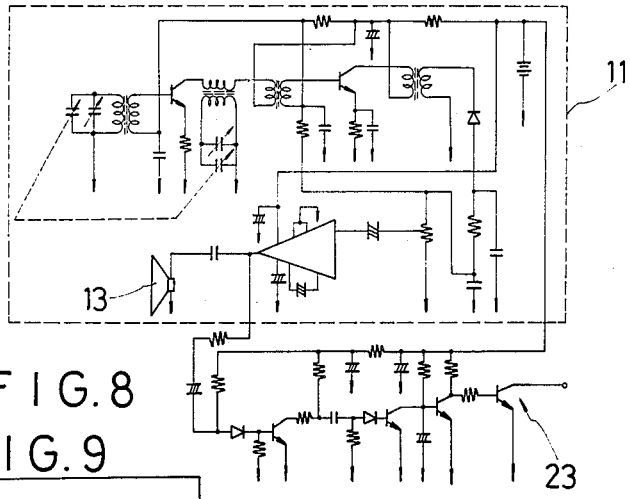
FIG. 8
FIG. 9
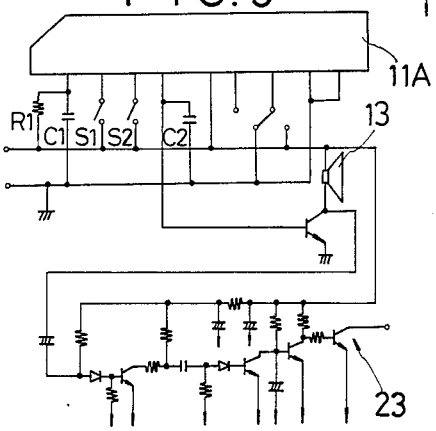
FIG. 10
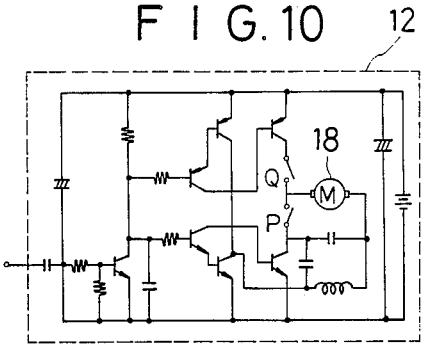
FIG. 11
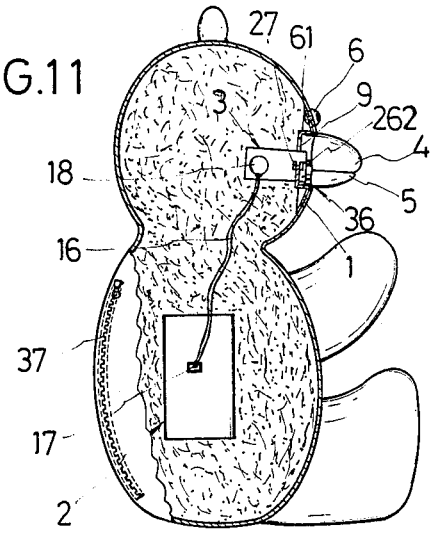

SYNCHRONIZED DRIVE DEVICE FOR THE MOUTH OF A DOLL

FIELD OF THE INVENTION

The present invention relates to a synchronized drive device for the mouth of a doll and, in particular, a device wherein the movement of the doll's mouth can match the sounds generated by a radio receiving circuit or language IC in the doll's body to produce synchronized opening and closing movements.

BACKGROUND OF THE INVENTION

Currently, most common dolls, made of cloth, velvet, plastics, or other deformable materials have different designs in their constructions. But since little consideration has been given to realistic sensitivity and interesting nature of the sounds and actions expressed by the dolls themselves, there is presently no way to fully emulate the enjoyment and appreciation that the dolls bring to the children during their playing and toying. Furthermore, radio broadcasts often air children's programs which tell stories in addition to broadcasting knowledge within the scope of the background suitable to children.

Therefore, it is often found that children carry a radio in one hand and also hold a doll in the other hand, sitting or lying on the floor and listening to stories aired by the radio stations. The voices transmitted by radio may be found by children to be monotonous and dull.

U.S. Pat. No. 3,865,200 provides a doll whose eyes and lips can move along with the sounds generated by the recorder mounted in its body. This is indeed a great improvement. However, its structure is complicated and the device is entirely joined to and fixed inside the doll. Such a structure is limited to use in hard shelled dolls. But it can scarcely perform its functions and actions if it is applied to dolls made of cloth, velvet or other soft materials.

OBJECTS OF THE INVENTION

A primary object of the present invention is to use the radio receiving circuit or language IC board and loud speaker device mounted in the dolls and also to utilize its amplified signals and bridge-type reverter which engage and cooperate with a magnetoelectric motor and a reduction gear set to drive appropriate drive rods into motion to make the upper jaws and lower jaws snap in and engage with their respective snap-in seats, thereby using the sounds generated by the loud speaker to generate the opening and closing actions of the jaws.

Another object of the present invention is to join all the above components into the main machine and control box which are joined together using the conductive wires and plugs forming the various connections herein described. The mouth frame may be installed inside the main body of the doll and the doll may be made of any material. The doll's upper and lower jaws can produce synchronous "opening" or "closing" actions along with the change of the sounds generated by the main machine.

SUMMARY OF THE INVENTION

The present invention provides a drive device for the lips of the doll's mouth which is able to be synchronized with electrically generated sounds. The mouth frame can be joined to a doll or any external configuration and made of any materials. It is merely necessary to open a hole in the mouth part of the doll's body to install the round mouth frame of this invention. The mouth frame snaps in and engages with the control box. It also may engage the eyes of the doll. The doll's upper and lower jaws are snapped in and engaged, with their snap-in tabs. The snap-in seats for the jaws are is provided on drive rods extending out from the front end of the control box. The snap-in seat can move along with the angular displacements of the drive rods to make the doll's upper and lower jaws open or close. The rear end of the control box is plugged (using the connecting conductive wires and plug) into the receptacle of the main machine in the doll's body.

The inner part of the main machine is joined to a set of radio receiving circuits (or language IC board), a loud speaker, batteries and bridge-type reverter. The radio receiving circuits or language IC board produces the received or generated audio frequency signals put out by the audio frequency signal amplifier. They also make the amplified audio frequency voltage rectified into a direct current rising or falling voltage. After the audio frequency voltage is amplified to drive the switch transistor into action, the switch transistor is subjected to control in accordance with the magnitude of the audio frequency signal amplitude to become electrically conductive or non-conductive. This controls the reverter to make the bridgetype reverter in turn control the rotation of the magnetoelectric motor mounted on the control box. The motor in turn drives the transmission mechanism to drive the front part of the drive rods into angular displacements to make the doll's upper and lower jaws move to produce "opening" or "closing" actions in accordance with the changes in the audio signals.

BRIEF DESCRIPTION OF THE DRAWINGS

FIGS. 5 and 6 are the views of the operation of the control box, in which FIG. 5 shows the two control rods parallel to position the doll's upper and lower jaws in a closed state; while FIG. 6 shows the control rods in the open state of the jaws.

FIG. 8 is a radio receiving circuit used by the example described of the present invention.

FIG. 9 is a view of the language IC used in the example described.

FIG. 10 is a view of the circuit of the bridge-type reverter according to the present invention.

FIG. 11 is a side view of the device of the present invention applied to a velvet doll.

SPECIFIC DESCRIPTION

Figure 1:
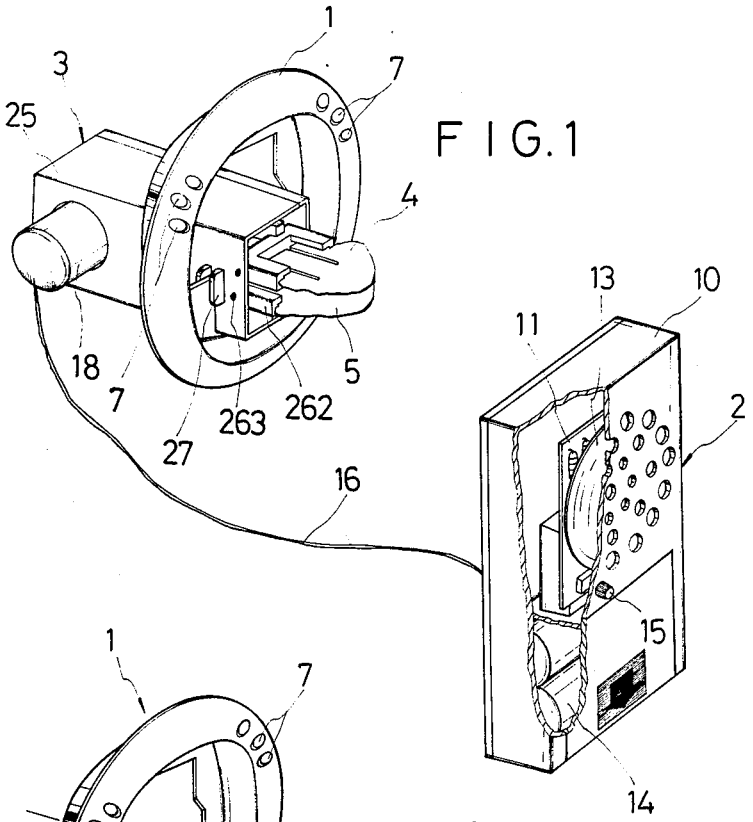
FIG. 1 is an external schematic view in perspective of one example of the device of the present invention, in which the doll's upper and lower jaws are partly omitted, while the main operating portion is shown partly in cross sectional view with the cover broken away.

Referring to FIGS. 1–11, the present invention is composed of the mouth frame 1, main operator or machine 2, control box 3, upper jaw 4, lower jaw 5, and eyes 6 to be installed in dolls which may be made of cloth, velvet, plastics or any other materials and in different forms.

Figure 2:
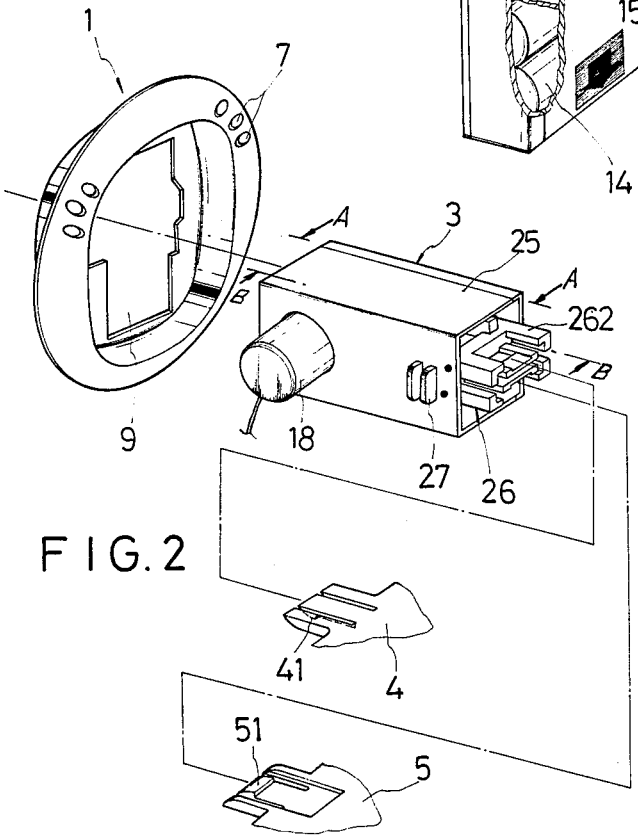
FIG. 2 is an exploded view of the mouth frame part of the example of FIG. 1.

The mouth frame 1 (as shown in FIGS. 1, 2, 11) is a round frame body with an external surface having an approximately convex arcuate shape. At each of the symmetrical positions on the two sides of the upper part of the frame body, a plurality of holes 7 are provided respectively to receive and mesh with the eyes 6 of the doll 8. The middle part of the frame has a vertical recess to form a receptacle for both of the doll's upper and lower jaws 4, 5 so that they can snap in and mesh with the control box 3. The control box 3 is provided on the bottom plate and can engage the snap-in holes 9, so that the front and rear sides of the control box 3 can penetrate into these holes to snap and engage the holes 9.

Figure 7:
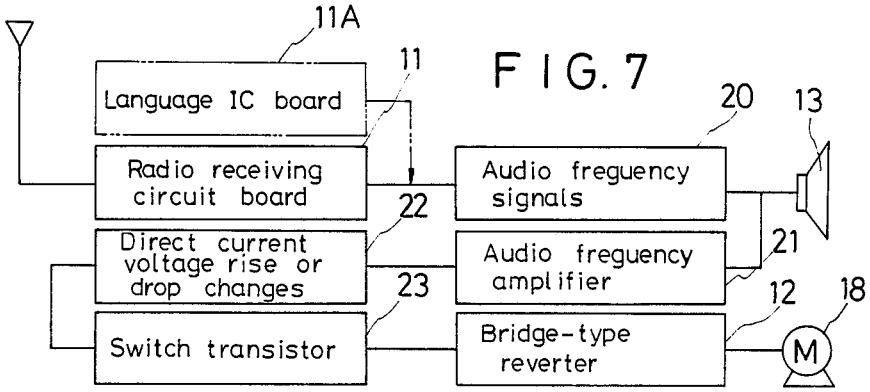
FIG. 7 is a block diagram of the circuit structure according to the present invention.

The main machine 2 (as shown in FIGS. 1, 7 and 11) is composed of the machine shell 10, radio receiving circuit board 11 or language IC board 11A, bridge type reverter 12, loud speaker 13, batteries 14, and knob 15. The machine which is connected by means of the connection conductive wires 16 and plug 17 to the magnetoelectric motor 18 and spring plate switch 19 in the control box 3. Its action is shown by the block diagram in FIG. 7.

The radio receiving circuit board 11 or language IC board 11A puts out the received or generated audio frequency signals 20 via the loudspeaker 13 after the audio frequency signals are amplified by the audio frequency amplifier 21 on the one hand. The amplified audio frequency voltage is rectified into the direct current voltage rise or drop changes 22. The audio frequency voltage is amplified to drive the switch transistor 23 into action to make the switch transistor 23 subject to the control of the vibration magnitude of the audio frequency to become electrically conductive or not so as to control the bridge-type reverter 12, thereby making the bridge-type reverter 12 control the rotations of the magnetoelectric motor 18 provided in the control box 3. The motor 18 in turn drives the transmission mechanism 24 and spring plate switch 19 to drive the doll's upper and lower jaws 4, 5 into opening or closing actions along with the changes of the signals.

Figure 3:
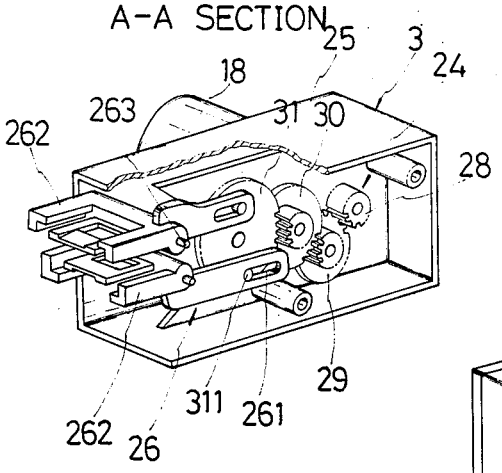
FIG. 3 is a cross sectional view of the control box along line A—A of FIG. 2.
Figure 4:
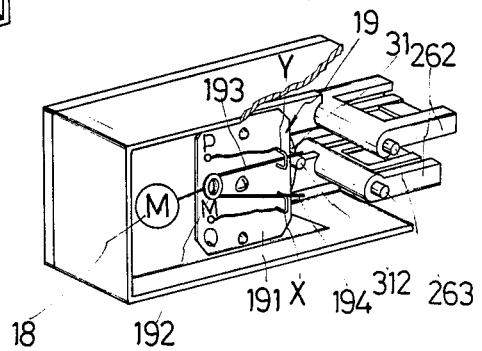
FIG. 4 is a cross sectional view of the control box along line B—B of FIG. 2.

The control box 3 is composed of the box body 25, magnetoelectric motor 18, transmission mechanism 24, drive rods 26, and spring plate switch 19 (as shown in FIGS. 2, 3, 4). The enclosing box body 25 is in a rectangular or other appropriate shape. Each of the two sides of the outer rim of the front part of the box is provided with a snap-in lug 27 (as shown in FIG. 2) respectively to snap in and mesh with the snap-in hole 9 in the bottom plate of the doll's mouth frame to fix the control box 3 therein. One side of the rear part of the box body 25 is joined to a magnetoelectric motor 18. The output shaft of that motor extends into the box body 25 to join the drive gear 28 of the transmission mechanism 24 which engages the reduction gears 29, 30 that drive the driven gears 31.

The external side of the driven gear 31 has two protruding pins 311 received in the elongate holes 261 provided in the drive rods 26. The inner side of the driven gear 31 has a touch rod 312 (as shown in FIG. 4). The rotation of the driven gear 31 touches the spring plate switch 19 into motion to control the power supply to the magnetoelectric motor 18. The above drive rods 26 are of a pair. The elongate hole 261 in each rear part of the drive rods 26 respectively receives and meshes with one of the two protruding pins 311 on the outer side of the driven gear 31 respectively. The front part of each drive rod is a snap-in seat 262 supported by the control box snap in and capable of receiving and meshing with the upper jaw 4 and the lower jaw 5 of the doll as the main body.

Figure 5:
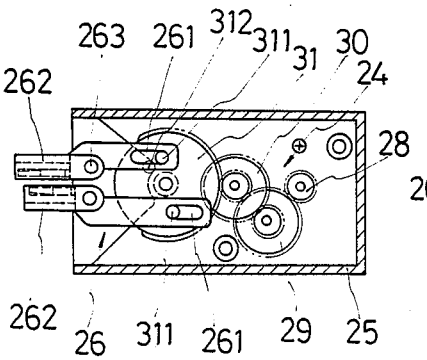
Figure 6:
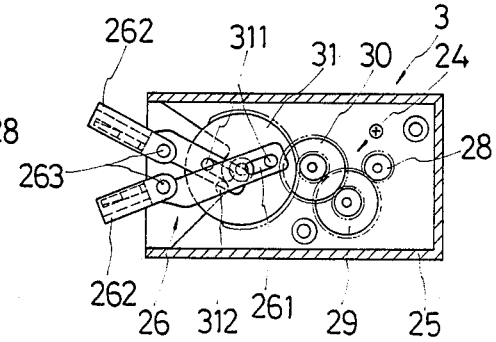

A pivot 263 is provided in the center of each of the drive rods respectively. Each pivot 263 is pivoted to the box body 25. When the magnetoelectric motor rotates clockwise or counterclockwise, it drives the pair of drive rods 26 for either opening or closing (as shown in FIGS. 5, 6).

The upper and lower jaws 4, 5 are respectively designed into the shape required to match the construction of the doll's as the main body. Protruding snap-in tabs 41, 51 are provided on the rear end of the drive rods 26 respectively to snap into the snap-in seats 262 on the front part of the drive rods 26 in order for the jaws to open or close along with the opening or closure of the drive rods 26.

The spring plate switch 19 (as shown in Fig. 4) uses the touch rod 312 provided on the inner side of the driven gear 31 to control the power supply for the magnetoelectric motor 18. A terminal seat 191 and conductive metal block 192 are provided on the switch 19. The terminal contact points P, Q, M are provided on the terminal seat 191. The spring plates 193, 194 are respectively connected to the two terminal points P, Q. The other ends of these spring plates extend on two sides of the touch rod 312. The terminal contact point M is connected, with conductive wires, to the conductive metal block 192.

When the loud speaker 13 generates sounds, the magnetoelectric motor 18 uses the bridge-type reverter 12 to put out a negative audio frequency signal via the terminal P. The drive gear 28 on the motor shaft drives the reduction gears 29, 30 to drive the driven gear 31 into rotation which in turn drives the drive rods 26 snapped in and meshed to the two protruding pins 311 into angular movements. This causes the upper and lower jaws 4, 5 snapped in and meshed to the snap-in seat 262 in its front part to produce angular displacements. At the same time, the touch rod 312 in the inner side of the driven gear 31, also rotates along with it. The touch rod 312 rotates to a position at which the rod 312 touches the spring plate 193 on the side of the touch rod and also directly presses the spring plate 193 off and away from the contact point Y on the conductive metal block 192 to cut off the power supply to the magnetoelectric motor 18. This makes the magnetoelectric motor stop its rotation which in turn makes the doll's upper and lower jaws appear to stop their opening action.

When the received audio frequency signals are discontinued and the loud speaker 13 no longer generates any sounds, the direction of the output of the bridge-type reverter is changed, such that the terminal contact points puts out a positive-phase signal instead to make the magnetoelectric motor rotate in a reverse direction. The drive gear 28 fixed on the shaft of the motor 18 drives the reduction gears 29, 30 into motion to drive the driven gear 31 to rotate in a reverse direction, thereby driving the drive rods 26, which are snapped in and meshed to the two protruding pins 311 on the driven gear 31, for angular displacement. This in turn makes the upper and lower jaws 4, 5 (snapped in and meshed with the snap-in seat 262 on the front part of the driven rods 26) also produce angular displacements. Meanwhile, the touch rod 312 in the inner side of the driven gear 31 also rotates along with the rotation of the driven gear 31, so the contact between the contact point Y on the conductive metal block 192 and the spring plate that is originally pressed away by the touch rod 312 will await the signal for reverse direction to be transmitted next time to directly press the spring plate 194 on the other side again, thereby making the spring plate 194 move off and away from the contact point X on the conductive metal plate 192. This cuts off the power supply to the magnetoelectric motor 18 to stop the rotation of the motor 18. When the doll's upper and lower jaws 4, 5 close, this will make the motor 18 not continuously rotate to waste the electric power. Such cyclic operations make the doll's upper and lower jaws 4, 5 conduct "opening" or "closing" actions in coordination with the sounds generated by the loud speaker 13.

FIG. 11 shows an example of the present invention applied to a velvet doll, in which a round opening 36 is provided in the mouth part of the doll's velvet shell body, and a mouth frame 1 is glued on the vertically sunk vertical wall of the center of the velvet along the rim of the round opening 36 for joining the eyes 6.

The eyes are fixed with screws 61 provided on the rear end of the eyes and which go through the holes 7 provided in the velvet and mouth frame 1 and also with nuts to insure that the mouth frame 1 may be positioned and may be joined to dolls in different constructions.

The control box 3 can be inserted into the mouth frame from the front side and then positioned in the snap-in hole 9 by means of the snap-in lugs provided on the two sides of the control box 3. The connection conductive wire 16 and plug 17 of the box 3 extend into the inner body of the doll to join the main machine 2 placed in the hole which is zipped open by zippers 37 provided on the doll's back. The doll's upper and lower jaws and snapped in and mesh with the snap-in seat 262 of the control box, and completing the assembly.

Therefore, the device of the present invention can be mounted on dolls in any different constructions and made of any materials, with the result that the doll's upper and lower jaws open or close along with the sounds given by the radio receiver or language IC.

What is claimed is:

1. A drive device for driving a pair of lips of a doll to move in response to an electrical signal from within the doll, comprising:

electrically operated means for generating sound, the sound generating means being designed for being disposed within the doll; a control box connected with the sound generating means;

a frame having an internal structure for receiving and for holding the control box in position with the lips projecting out of the control box;

a motor at the control box for being driven to rotate in a first and a second direction with respect to the control box; means responsive to an electrical signal which operates the sound generating means and connected with the motor at the control box for operating the motor to rotate in one of the first and the second directions;

a first and a second separately pivotable drive rod and a respective pivot for the drive rods on the device, each drive rod being connected with the motor for being moved by the motor to pivot around its respective pivot; a respective lip of the pair of lips connected to each of the pivotable drive rods such that pivoting of the rods moves the rods and therefore the lips alternatively together and apart;

and switch means for selectively switching the motor to rotate in the first direction for moving the pivotable rods to move the lips apart and for halting in the second direction the operation of the motor when the lips have moved predetermined distance apart and for operating the motor for moving the pivotable rods to move the lips together and for halting the operation of the motor once the lips have moved together.

2. The combination of claim 1, comprising a drive gear connected with the motor, the motor rotating the drive gear in the first and the second directions; the drive rods being pivotally connected in the control box to pivot around respective pivots in the control box, the drive rods extending beyond and being further connected beyond one side of the pivots to the respective lips and extending beyond and being connected beyond the other side of the pivots to the drive gear, such that rotation of the drive gear in the first direction moves the drive rods and the lips apart and rotation of the drive gear in the second direction moves the drive rods and the lips together.

3. The combination of claim 2, wherein the drive gear has a respective pin protruding from a side thereof for each of the drive rods, and each of the drive rods has a respective elongate hole therein which receives the respective pin therefor, such that the pin may rotate with the drive gear and pivot the drive rods.

4. The combination of claim 4, wherein the means for turning off and on the motor comprises first and second contacts which, respectively, when connected to the motor will cause the motor to rotate in the first and second directions; touch means supported on the drive gear and movable respectively into engagement with the first and second of the contacts for selectively turning the motor off after the motor has rotated a predetermined amount in the first direction and for turning the motor off after the motor has rotated a predetermined amount in the second direction.

5. The combination of claim 1, further comprising a snap-in seat on the respective drive rod for each lip and each lip being snapped into the respective seat therefor on the respective drive rod.

6. The combination of claim 1, wherein the mouth frame is generally round in shape, and has an upper part toward which the mouth frame is provided with a plurality of symmetrical pairs of holes for receiving eyes of the doll; and the doll having a pair of eyes, each respectively received in one of the symmetric pair of a holes.

* * * * *